US008265874B2

(12) United States Patent
Ma et al.

(10) Patent No.: US 8,265,874 B2
(45) Date of Patent: Sep. 11, 2012

(54) EXPERT SYSTEM FOR SELECTING FIT-FOR-PURPOSE TECHNOLOGIES AND WELLS FOR RESERVOIR SATURATION MONITORING

(75) Inventors: Shouxiang M Ma, Dhahran (SA); Abdrabrasool A Al-Hajari, Majediah (SA); Kamran B Husain, Dhahran (SA)

(73) Assignee: Saudi Arabian Oil Company (SA)

( * ) Notice: Subject to any disclaimer, the term of this patent is extended or adjusted under 35 U.S.C. 154(b) by 288 days.

(21) Appl. No.: 12/764,391

(22) Filed: Apr. 21, 2010

(65) Prior Publication Data

US 2011/0264372 A1 Oct. 27, 2011

(51) Int. Cl.
*G06F 19/00* (2011.01)

(52) U.S. Cl. ..... 702/6

(58) Field of Classification Search ..... 702/6, 7, 702/8; 166/250.01

See application file for complete search history.

(56) References Cited

U.S. PATENT DOCUMENTS

| | | | | |
|---|---|---|---|---|
| 4,507,735 | A | 3/1985 | Moorehead | |
| 5,668,369 | A | 9/1997 | Oraby | |
| 7,258,175 | B2 | 8/2007 | Veeningen | |
| 7,277,796 | B2 * | 10/2007 | Kuchuk et al. | 702/7 |
| 7,280,932 | B2 | 10/2007 | Zoraster | |
| 7,395,252 | B2 | 7/2008 | Anderson | |
| 2005/0209836 | A1 | 9/2005 | Klumpen | |
| 2005/0209866 | A1 | 9/2005 | Veeningen | |
| 2005/0209912 | A1 | 9/2005 | Veeningen | |
| 2005/0211468 | A1 | 9/2005 | Veeningen | |
| 2005/0228905 | A1 | 10/2005 | Veeningen | |
| 2007/0246649 | A1 | 10/2007 | Jacobi | |
| 2008/0059002 | A1 | 3/2008 | Hartkamp | |
| 2008/0262802 | A1 | 10/2008 | Halabe | |
| 2008/0294387 | A1 | 11/2008 | Anderson | |

* cited by examiner

*Primary Examiner* — Bryan Bui
(74) *Attorney, Agent, or Firm* — Bracewell & Giuliani LLP

(57) ABSTRACT

Embodiments of the present invention provide a machine, program product, and computer-implemented method to select a fit-for-purpose tool for reservoir saturation monitoring. A computer stores a plurality of characteristics for a plurality of well-logging tools, including open hole and closed hole resistivity, pulse-neutron spectral carbon-oxygen, and pulse-neutron capture technologies, as well as a predetermined ranking of tools within a technology. The computer obtains user inputs associated with conditions of a candidate well, e.g., a minimum tubing restriction, whether the wellbore is open or cased, and whether the well is a wet producer. Inputs can also include an objective of the reservoir saturation monitoring, such as, evaluating sweep efficiency or identifying remaining pay for sidetrack or perforation. The computer compares the characteristics for the well-logging tools to the user inputs and determines a well-logging tool selection responsive to the comparison to thereby recommend a course of action for the candidate well.

20 Claims, 9 Drawing Sheets

EXPERT SYSTEM FOR SELECTING FIT-FOR-PURPOSE TECHNOLOGIES AND WELLS FOR RESERVOIR SATURATION MONITORING

FIELD OF THE INVENTION

The present invention relates generally to reservoir saturation monitoring in petrophysics and reservoir management, and, more particularly, to a computer-implemented method, program product, and apparatus for an expert system for selecting tool, technologies, and well for reservoir monitoring and for identifying zones for sidetrack or perforation.

BACKGROUND OF THE INVENTION

Monitoring saturation changes in an oil field over time, known as reservoir saturation monitoring (RSM), is a routine operation for oil companies to assess oil recovery efficiency and to identify zones for sidetrack or perforation. Reservoir saturation monitoring offers particular advantages for parts of a field that have started producing water. Currently, decisions relating to reservoir saturation monitoring involve petrophysicists, in consultation with reservoir and production engineers and service-company logging engineers. Although routine, RSM is a complex and time-consuming operation. In addition, RSM decisions are subject to human error.

Various logging technologies, from various vendors, can be available for or involved with reservoir saturation monitoring, and each logging technology has its advantages and disadvantages. For example, deep resistivity logs read more than 10 times deeper into a reservoir than shallow carbon-oxygen logs; resistivity logs are, however, water salinity dependent, unlike carbon-oxygen logs, and do not provide desirable results in a fresh or mixed water environment.

Wells having various well conditions and attributes can be the subject of reservoir saturation monitoring. For example, candidate wells for RSM can include active wet producers with different water cuts, different minimum tubing restrictions, different logging intervals, wells that have been dead or shut-in for a long time, wells that have been mothballed by pumping thousands gallons of diesel, and wells that have been massively acidized (and thus near-wellbore rock properties may have been altered). Moreover, these conditions can affect the technologies associated with reservoir saturation monitoring.

Thus, there exists a need for more reliable and efficient methods and apparatuses for the determining appropriate technologies for well saturation monitoring.

SUMMARY

Embodiments of the present invention provide an automated expert system, with knowledge of the advantages and disadvantages of various logging technologies, including technologies from multiple vendors, to select fit-for-purpose technologies for reservoir saturation monitoring responsive to well conditions.

Accordingly, embodiments of the present invention provide, for example, an expert system to select a fit-for-purpose tool for reservoir saturation monitoring. An expert system is machine, e.g., computer hardware and software, that attempts to reproduce the reasoning of human specialists. Creating an expert system can include capturing the knowledge of subject matter experts and developing rules, criteria, and guidelines for making complex decisions in accordance with the reasoning, judgment, and experience of a collection of human specialists. Expert systems include systems that incorporate feedback, e.g., that continue to "learn" or adapt the decision process, as well as systems that require reprogramming or additional configuration to alter or update the decision process. Expert systems can be dynamic systems that can be updated based on the development of new technologies. Once created, an expert system can then be used by a non-specialist to reproduce the reasoning of the human specialist; in addition, the expert system can be used by a specialist to reduce errors and to improve efficiency.

Embodiments of the present invention include, for example, an expert system with knowledge of various well logging technologies, from various vendors, with each logging technology having advantages and disadvantages.

Example embodiments of the present invention include, for example, a machine to select a fit-for-purpose tool for reservoir saturation monitoring. The machine can include a processor positioned to determine a well-logging tool selection responsive to a plurality of characteristics of a well-logging tool for a plurality of well-logging tools from a plurality of vendors and responsive to conditions for a candidate well. The characteristics of a well-logging tool can include, for example, an outer diameter of the tool and a well-logging technology utilized by the tool. The machine can include an input/output interface for receiving and displaying data between the processor and a user. The machine can include a memory having stored therein computer program product. The computer program product can be stored on a tangible and non-transitory computer memory media and operable on the processor; the computer program product can include a set of instructions that, when executed by the processor, cause the processor to determine a well-logging tool selection by performing various operations. The operations can include, for example, storing the plurality of characteristics for the plurality of well-logging tools. The operations can include receiving by the processor a first one or more inputs from the user. The first one or more inputs can be associated with a condition of a candidate well. The operations can include prompting the user for a second one or more inputs associated with the conditions of the candidate well by the processor through the input/output interface responsive to the first one or more inputs. The operations can include comparing by the processor the stored plurality of characteristics for the plurality of well-logging tools to the first and second one or more inputs associated with conditions of the candidate well. The operations can include determining a well-logging tool selection by the processor responsive to the comparison to thereby recommend a course of action for reservoir saturation monitoring of the candidate well.

Embodiments of the present invention include, for example, computer program product, stored on a tangible and non-transitory computer memory media and operable on a computer. The computer program product includes a set of instructions that, when executed by the computer, cause the computer to determine a well-logging tool selection by performing various operations. The operations can include, for example, storing in a database in tangible and non-transitory computer memory media a plurality of characteristics of a well-logging tool for a plurality of well-logging tools from a plurality of vendors. The characteristics of a well-logging tool can include an outer diameter of the tool and a well-logging technology utilized by the tool. The operations can include obtaining from a user a plurality of inputs associated with conditions of a candidate well. The operations can include comparing the stored plurality of characteristics for the plurality of well-logging tools to the plurality of inputs associated with conditions of the candidate well. The operations can further include determining a well-logging tool selection responsive to the comparison of the stored plurality of characteristics for the plurality of well-logging tools to the plurality of inputs associated with conditions of the candidate well to thereby recommend a course of action for reservoir saturation monitoring of the candidate well.

Embodiments of the present invention include, for example, a computer-implemented method to select a fit-for-purpose tool for reservoir saturation monitoring. The computer-implemented method can include, for example, storing by a computer in a database in tangible and non-transitory computer memory a plurality of characteristics of a well-logging tool for a plurality of well-logging tools from a plurality of vendors. The characteristics of a well-logging tool can include, for example, an outer diameter of the tool and a well-logging technology utilized by the tool. The computer-implemented method can include, for example, obtaining from a user by the computer in a first computer process a plurality of inputs associated with conditions of a candidate well. The computer-implemented method can include, for example, comparing by the computer in a second computer process the stored plurality of characteristics for the plurality of well-logging tools to the plurality of inputs associated with conditions of the candidate well from the first computer process. The computer-implemented method can include, for example, determining a well-logging tool selection by the computer responsive to the comparison of the stored plurality of characteristics for the plurality of well-logging tools to the plurality of inputs associated with conditions of the candidate well from the first computer process to thereby recommend a course of action for reservoir saturation monitoring of the candidate well.

An expert system according to embodiments of the present invention can recommend one or more vendor-specific technologies for RSM amongst the various available from multiple vendors, responsive to well various conditions, to maximize the advantages and minimize the disadvantages of each technology.

DETAILED DESCRIPTION

Figure 1:
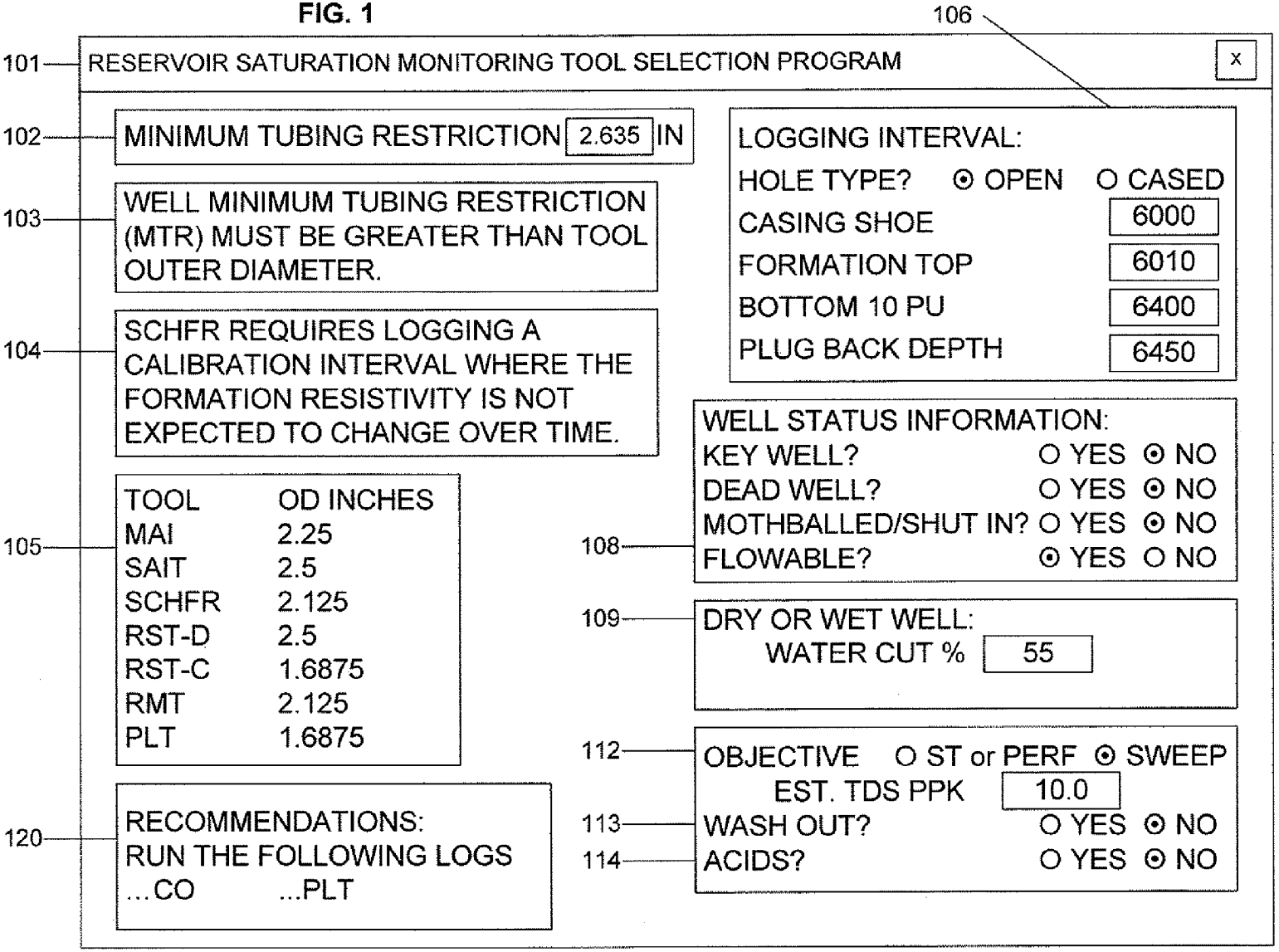
FIG. 1 is a front plan view of a display screen of a computer displaying a visual depiction of reservoir saturation monitoring tool selection program according to an embodiment of the present invention.

Although the following detailed description contains many specific details for purposes of illustration, it is understood that one of ordinary skill in the art will appreciate that many examples, variations and alterations to the following details are within the scope and spirit of the invention. Accordingly, the exemplary embodiments of the invention described herein are set forth without any loss of generality to, and without imposing limitations thereon, the claimed invention.

Applicants have recognized a need for more reliable and efficient computer-implemented methods, program products, and apparatuses, e.g., machines, for the determining appropriate technologies for well saturation monitoring (RSM). Applicants have also recognized one or more sources of the problem associated with technology selection. Currently, decisions relating to reservoir saturation monitoring involve petrophysicists, in consultation with reservoir and production engineers and service-company logging engineers. Although routine, RSM decisions are complex, time-consuming, and subject to human error.

Accordingly, embodiments of the present invention provide, for example, an expert system to select a fit-for-purpose tool for reservoir saturation monitoring. An expert system is machine, e.g., computer hardware and software, that attempts to reproduce the reasoning of human specialists. Creating an expert system can include capturing the knowledge of subject matter experts and developing rules, criteria, and guidelines for making complex decisions in accordance with the reasoning, judgment, and experience of a collection of human specialists. Expert systems include systems that incorporate feedback, e.g., that continue to "learn" or adapt the decision process, as well as systems that require reprogramming or additional configuration to alter or update the decision process. Once created, an expert system can then be used by a non-specialist to reproduce the reasoning of the human specialist; in addition, the expert system can be used by a specialist to reduce errors and to improve efficiency.

Embodiments of the present invention include, for example, an expert system with knowledge of various well logging technologies, from various vendors, with each logging technology having advantages and disadvantages. Well logging involves the making of a detailed record of the geologic formations, including associated fluids and conditions. Logs can be based on physical measurements by instruments lowered into the well, including electrical, acoustic, radioactive, electromagnetic, and other properties of the formations and the associated fluids.

As understood by those skilled in the art, various vendors develop, market, and sell well logging tools, including, for example, Schlumberger, Halliburton, and Weatherford corporations. As understood by those skilled in the art, Schlumberger Limited has principal offices in Paris, Houston and The Hague, Netherlands. As understood by those skilled in the art, Halliburton Co. has corporate offices in Houston, Tex., United States of America and Dubai, United Arab Emirates. As understood by those skilled in the art, Weatherford International Ltd. has corporate offices in Houston, Tex., United States of America.

Well logging technologies can be classified by the technology of the instruments. One example well logging technology is the carbon-oxygen (CO) log, which can measure the oil in a formation. As understood by those skilled in the art, carbon-oxygen tools include the Schlumberger RST-C, Schlumberger RST-D, and Halliburton RMT tools. Another well logging technology is resistivity, which measures electrical resistivity of a formation. Resistivity is a fundamental property of a material and represents how strongly a material opposes the flow of electric current. Because saline water is more conductive than hydrocarbons and gives the reservoir rock it saturates a lower resistivity than rock saturated with hydrocarbons, the location of oil-water contact can be determined from a resistivity log responsive to a large change in the resistivity. Resistivity is also an indicator for permeability. As understood by those skilled in the art, resistivity tools include the Schlumberger SAIT for open-hole wells, Schlumberger SCHFR for cased-hole wells, and Weatherford MAI for open-hole wells. Yet another well logging technology is pulse neutron capture logging (PNC, or PNL), which are devices that read deeper than CO technology but still much shallower than resistivity technology.

An expert system according to embodiments of the present invention can recommend one or more technologies for RSM amongst the various available, responsive to well various conditions, to maximize the advantages and minimize the disadvantages of each technology. For example, the resistivity logs can read more than 10 times deeper into a reservoir than shallow carbon-oxygen logs; resistivity logs are, however, water salinity dependent, unlike carbon-oxygen logs, and do not provide desirable results in a fresh or mixed water environment. For example, candidate wells can include active wet producers with different water cuts, different minimum tubing restrictions, different logging intervals, wells that have been dead or shut-in for a long time, wells that have been mothballed by pumping thousands gallons of diesel, and wells that have been massively acidized (and thus near-wellbore rock properties may have been altered). The various well conditions of a candidate well can affect the fit, e.g., usefulness, of technologies associated with reservoir saturation monitoring.

Figure 2:
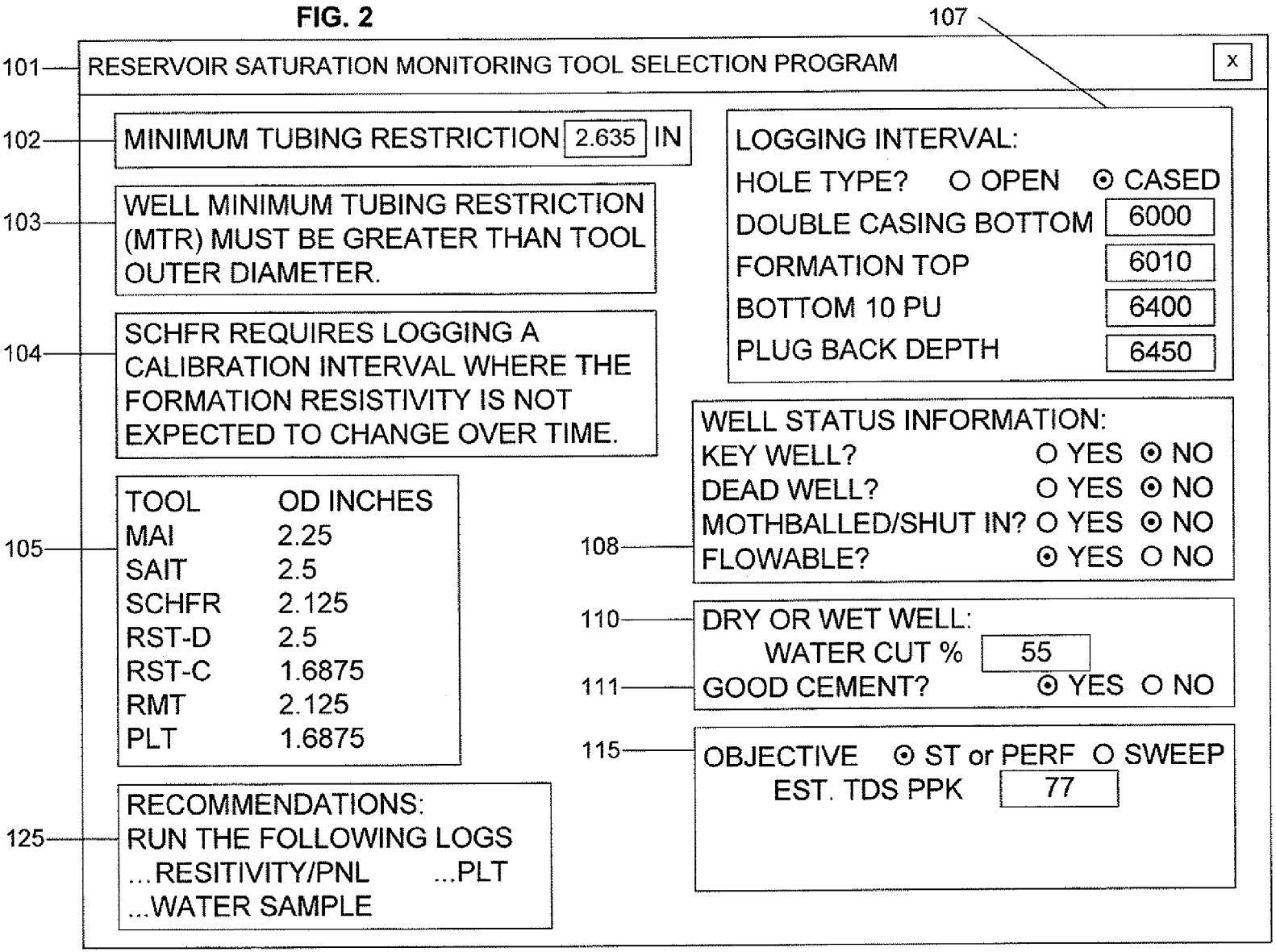
FIG. 2 is a front plan view of a display screen of a computer displaying a visual depiction of reservoir saturation monitoring tool selection program according to another embodiment of the present invention.
Figure 3:
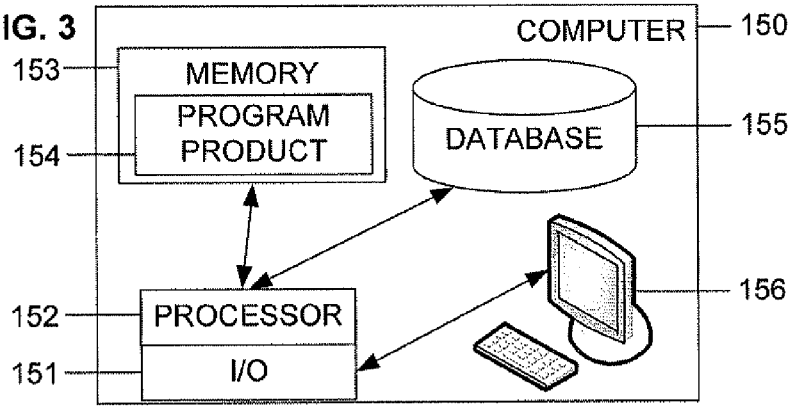
FIG. 3 is a schematic block diagram of a machine to select a fit-for-purpose tool for reservoir saturation monitoring according to an embodiment of the present invention.
Figure 4:
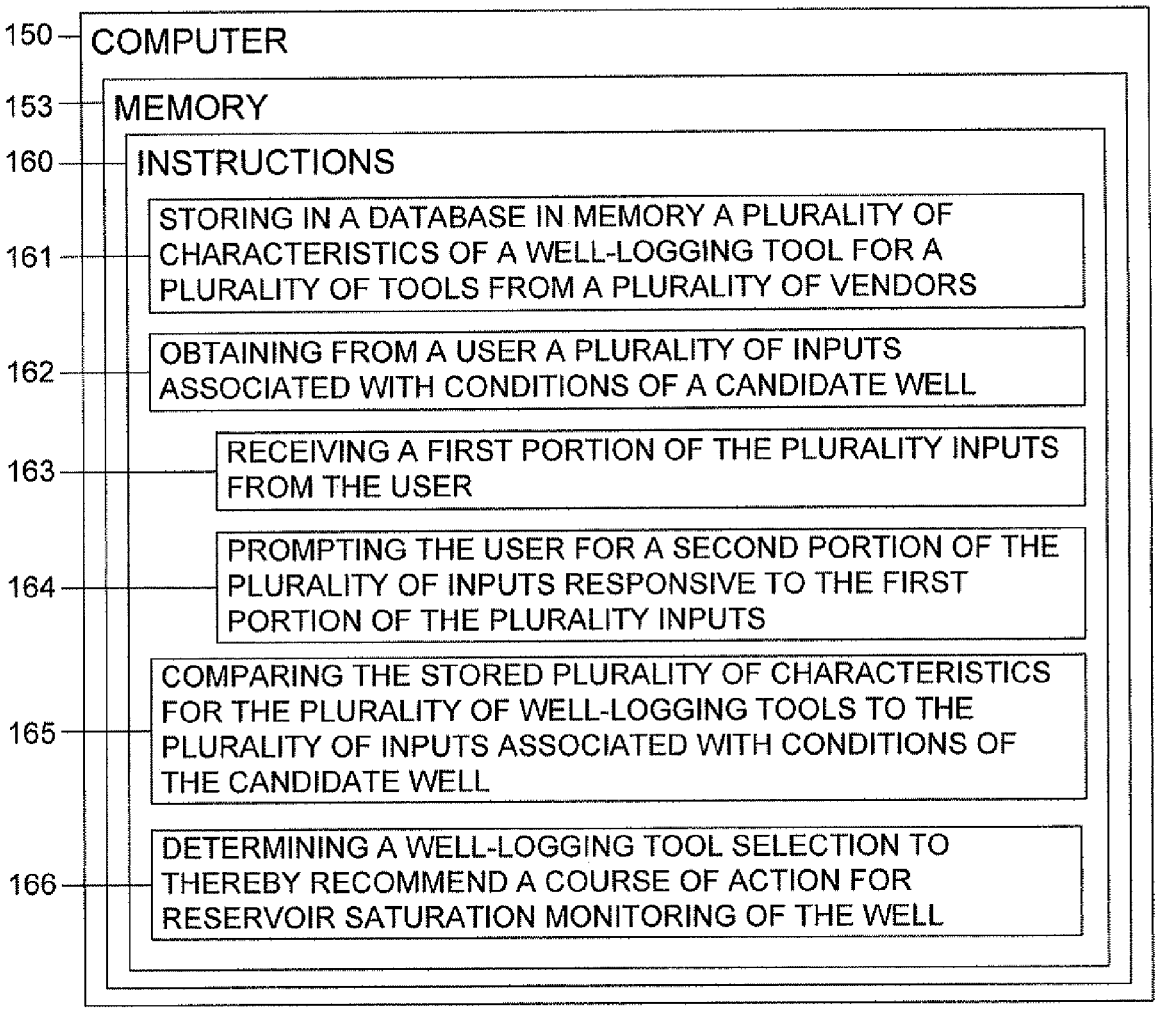
FIG. 4 is a schematic block diagram of a computer having a computer program product stored on a tangible and non-transitory computer memory media according to an embodiment of the present invention.

As illustrated in FIGS. 1-4 and 7 embodiments of the present invention include, for example, a machine to select a fit-for-purpose tool for reservoir saturation monitoring. As illustrated in FIG. 3, the machine 150 can include, for example, a processor 152. The processor 152 can be positioned to determine a well-logging tool selection responsive to a plurality of characteristics of a well-logging tool for a plurality of well-logging tools from a plurality of vendors and responsive to conditions for a candidate well. The characteristics of a well-logging tool can include an outer diameter of the tool and a well-logging technology utilized by the tool. The characteristics can be stored in a database 155 in communication with the processor 152. The machine 150 can include an input/output interface 151 for receiving and displaying data between the processor and a user. For example, the input/output interface 151 can communicate to a display 156 for interacting with a user. The machine 150 can include a memory 153 having stored therein a program product 154, stored on a tangible and non-transitory computer memory media and operable on the processor 152. The program product 154 can include a set of instructions 160 that, when executed by the processor 152, cause the processor 152 to determine a well-logging tool selection by performing various operations, as illustrated in FIG. 4. The operations can include storing in a database 155 a plurality of characteristics for the plurality of well-logging tools 161 to thereby enable categorization of the well-logging tools from the plurality of vendors, the categorization being according to the plurality of characteristics. The operations can include obtaining from a user a plurality of inputs associated with conditions of a well 162 so that the processor can select amongst the plurality of well-logging tools according to the categorization of the well-logging tools responsively to the conditions of the candidate well. This operation 162 can include the substeps of receiving by the processor 152 a first one or more inputs from the user 163, wherein each of the one or more inputs is associated with a condition of a candidate well, to thereby avoid irrelevant input gathering, and prompting the user for a second one or more inputs associated with the conditions of the candidate well by the processor 152 through the input/output interface 151 responsive to the first one or more inputs 164 so that additional relevant inputs are obtained. The operations can include comparing by the processor 152 the stored plurality of characteristics for the plurality of well-logging tools to the first and second one or more inputs associated with conditions of the candidate well 165 to thereby match the candidate well to suitable well-logging tools of the plurality of well-logging tools. The operations can include determining a well-logging tool selection by the processor 152 responsive to the comparison of the stored plurality of characteristics for the plurality of well-logging tools to the first and second one or more inputs to select a fit-for-purpose tool for reservoir saturation monitoring so that the computer creates for the user a recommendation for reservoir saturation monitoring of the candidate well 166.

Figure 7:
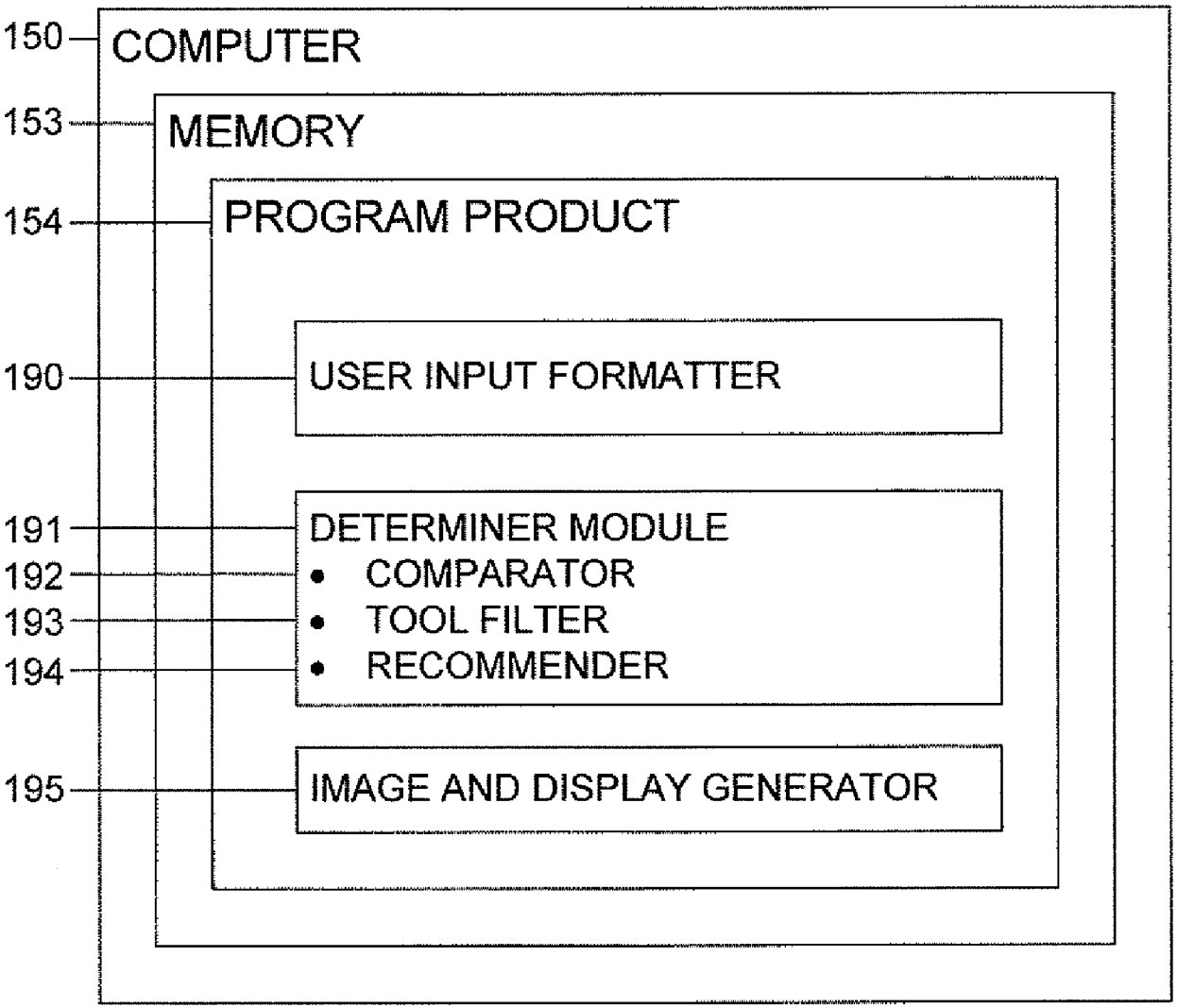
FIG. 7 is a schematic block diagram of a computer having a computer program product stored on a tangible and non-transitory computer memory media according to an embodiment of the present invention.

As illustrated in FIG. 7, the program product 154, residing in the tangible and non-transitory memory 153 and operable on the computer 150, can include a set of modules that perform the embodiments of the present invention. For example, the modules can include a user input formatter 190. The formatter 190 module can, for example, obtain from a user a plurality of inputs associated with conditions of a well, format, and store the inputs accordingly. The modules can include a determiner module 191. The determiner module 191 can, for example, include a comparator 192 that compares the stored plurality of characteristics for the plurality of well-logging tools to the inputs associated with conditions of the candidate well. The determiner module 191 can, for example, include a tool filter 193 that eliminates well-logging tools responsive to mechanical fit, ill-suited technology for the conditions of the candidate well, cost considerations, and ill-suited technology for the objective of the reservoir saturation monitoring for the candidate well. The determiner module 191 can, for example, include recommender 194 to select a fit-for-purpose tool for reservoir saturation monitoring and create for the user a recommendation for reservoir saturation monitoring of the candidate well. The modules can include an image and display generator 195. The image and display generator 195 can, for example, display to a user through a display screen of a computer the reservoir saturation monitoring tool selection program 101. See, e.g., FIGS. 1 and 2. The image and display generator 195 can also, for example, display to a user through a display screen of a computer a simulation of a mechanical fit of a well-logging tool and a candidate well; a simulation or representation of a candidate well, including, for example, whether the wellbore is open or cased; and a image representation of the selected fit-for-purpose tool for reservoirs saturation monitoring. As understood by those skilled in the art, these modules, i.e., the user input formatter 190, the determiner module 191, and the image and display generator 192, can each be computer program product. That is, each module can, for example, be stored on a tangible and non-transitory computer memory media, be operable on the processor, and include a set of instructions that, when executed by the processor, cause the processor to perform various operations and embodiments of the present invention described herein.

As illustrated in FIGS. 1 and 2, embodiments of the present invention can include a reservoir saturation monitoring tool selection program being displayed on a display screen of a computer. (See also, e.g., 156 in FIG. 3.) The reservoir saturation monitoring tool selection program 101 can include receiving from the user inputs associated with a condition of a candidate well. For example, the reservoir saturation monitoring tool selection program 101 can include an input for a minimum tubing restriction for the candidate well 102. In addition, the reservoir saturation monitoring tool selection program 101 can include explanations of the importance of the input, including, for example, that the well minimum tubing restriction (MTR) must be greater than tool outer diameter 103. That is, the well logging tool must be able to mechanically fit in the well, and the expert system would not recommend a well logging tool that does not fit. Likewise, the reservoir saturation monitoring tool selection program 101 can display selective characteristics of various tools, including, for example, outer diameters of various tools 105 or a limitation of a particular tool or technology 104. Other user inputs associated with a condition of a candidate well can include, for example, information regarding the borehole 106 and 107, including, for example, whether the wellbore is open or cased, a casing shoe or double casing bottom, a formation top, a bottom of 10 percentage porosity unit (PU) rock, and a plug back depth. As understood by those skilled in the art, the plug back depth measures the current bottom of the borehole and is the physical bottom of the borehole which is plugged either by cement or by a mechanical plug. The plug back total depth is shallower than the total depth drilled and can change in time. Still other user inputs associated with a condition of a candidate well can include, for example, well status information 108 as understood by those skilled in the art, including, for example, whether the well is a key well in which well-logging cost is a secondary consideration; whether the well is a dead well; whether the well has been mothballed or shut in; and whether the well is flowable. Additional user inputs can include, for example, the water cut 109, 110, which represents the ratio of water produced compared to the volume of total liquids produced.

Other user inputs can include, for example, an objective of the reservoir saturation monitoring as illustrated in FIGS. 1 and 2, which can affect the tool selection. Objectives can include, for example, identifying remaining pay for sidetrack or perforation 115 and evaluating the waterflood sweep efficiency 112. As understood by those skilled in the art, the waterflood sweep efficiency involves the efficiency of waterflooding, a method of secondary recovery in which water is injected into the reservoir formation through injection wells to sweep oil to adjacent production wells. As understood by those skilled in the art, sidetrack involves a secondary wellbore drilled away from an original wellbore, perhaps to target the remaining pay, an unusable section of the original wellbore or explore a geologic feature nearby.

Additional user inputs can include, for example, well history, including whether the well has suffered washout 113, e.g., a widening of the wellbore due to erosion, or whether extensive acid jobs were performed in the well 114 (which can alter near wellbore rock properties such as porosity especially for carbonate reservoirs, as understood by those skilled in the art). Another user input can include, for example, whether this is a freshwater environment, including an estimated total dissolved solids (TDS), typically provided in units of parts per thousand (PPK).

The reservoir saturation monitoring tool selection program 101 can also prompt the user for a second one or more inputs associated with the conditions of the candidate well responsive to the first one or more inputs. For example, if the wellbore is cased hole, as indicated in 107 of FIG. 2, the reservoir saturation monitoring tool selection program 101 can prompt for a user input whether the cement is in good condition, as indicated in 111. If the wellbore is an open well, as indicated in 106 of FIG. 1, then the reservoir saturation monitoring tool selection program 101 does not prompt for this input to avoid irrelevant inputs, i.e., confusing, extraneous, and nonsensical inputs. (Likewise, see, e.g., 112-114 of FIG. 1 compared to 115 of FIG. 2.)

As further illustrated in FIGS. 1 and 2, the reservoir saturation monitoring tool selection program 101 can determine a well-logging tool selection responsive to the comparison of the stored plurality of characteristics for the plurality of well-logging tools to the first and second one or more inputs to thereby recommend a course of action for reservoir saturation monitoring of the candidate well or create for the user a recommendation for reservoir saturation monitoring of the candidate well. See, e.g., 120 of FIG. 1 and 125 of FIG. 2, in which different recommendations are made responsive to the different inputs.

Figure 5:
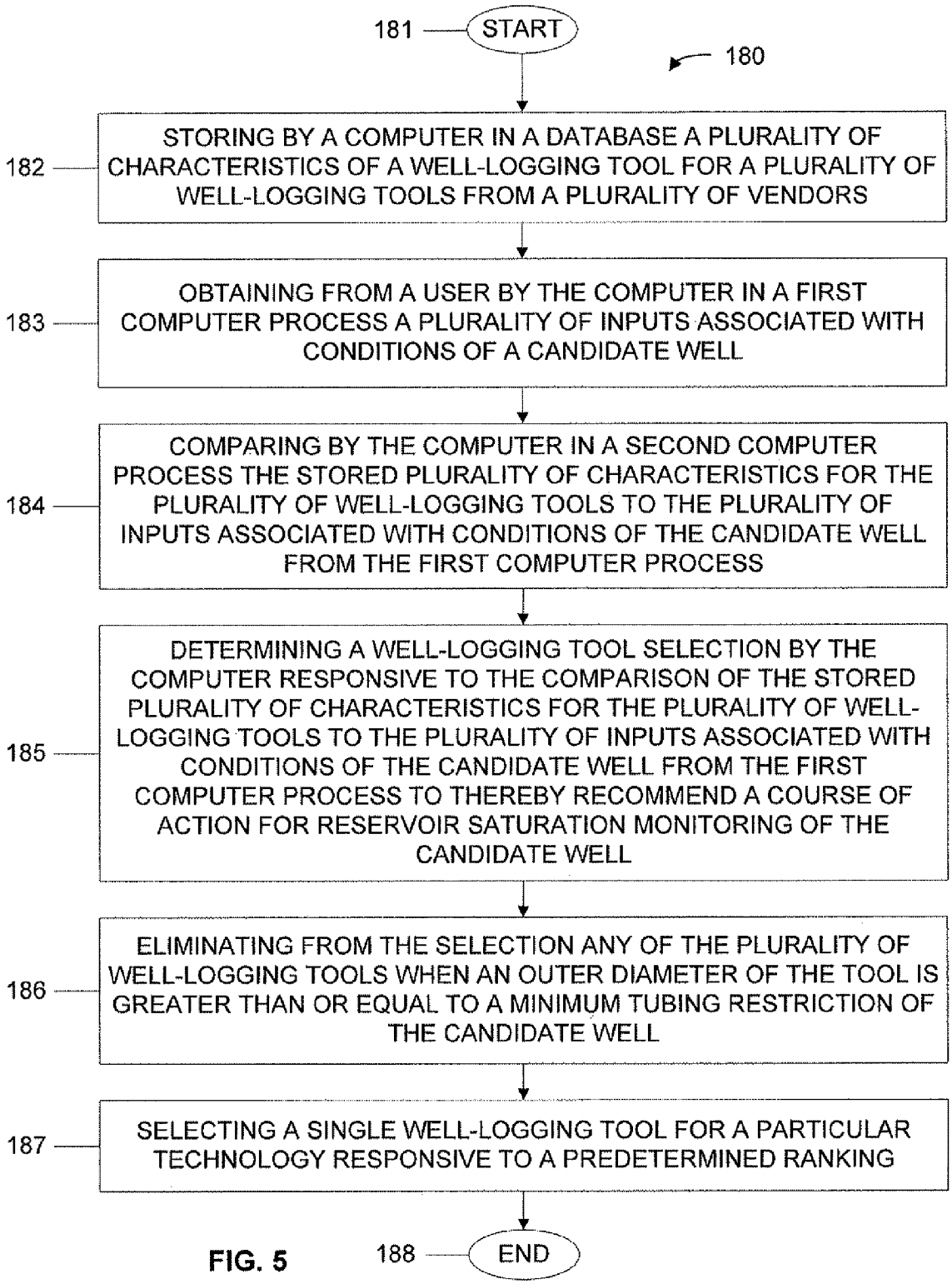
FIG. 5 is a schematic flow diagram of a computer-implemented method to select a fit-for-purpose tool for reservoir saturation monitoring according to an embodiment of the present invention.

As illustrated in FIG. 5, embodiments of the present invention can include a computer-implemented method to select a fit-for-purpose tool for reservoir saturation monitoring 180. The computer-implemented method 180 can include, for example, storing by a computer in a database in tangible and non-transitory computer memory a plurality of characteristics of a well-logging tool for a plurality of well-logging tools from a plurality of vendors 182 to thereby enable categorization of the well-logging tools from the plurality of vendors, the categorization being according to the plurality of characteristics. The characteristics of a well-logging tool can include, for example, an outer diameter of the tool and a well-logging technology utilized by the tool. The computer-implemented method 180 can include, for example, obtaining from a user by the computer in a first computer process a plurality of inputs associated with conditions of a candidate well 183 so that the computer can select amongst the plurality of well-logging tools according to the categorization of the well-logging tools responsively to the conditions of the candidate well. The computer-implemented method 180 can include, for example, comparing by the computer in a second computer process the stored plurality of characteristics for the plurality of well-logging tools to the plurality of inputs associated with conditions of the candidate well from the first computer process 184 to thereby match the candidate well to suitable well-logging tools of the plurality of well-logging tools. The computer-implemented method 180 can include, for example, determining a well-logging tool selection by the computer responsive to the comparison of the stored plurality of characteristics for the plurality of well-logging tools to the plurality of inputs associated with conditions of the candidate well from the first computer process to thereby recommend a course of action for reservoir saturation monitoring of the candidate well 185 to select a fit-for-purpose tool for reservoir saturation monitoring so that the computer creates for the user a recommendation for reservoir saturation monitoring of the candidate well. The step of determining a well-logging tool selection can further include eliminating from the selection any of the plurality of well-logging tools when an outer diameter of the tool is greater than or equal to a minimum tubing restriction of the candidate well so that the computer selects well-logging tools that mechanically fit in the candidate well 186 and selecting a single well-logging tool for a particular technology responsive to a predetermined ranking to thereby avoid duplication of well-logging tools with respect to the particular technology 187. For example, a predetermined ranking of carbon-oxygen CO tools can include a preference for Schlumberger RST-D over Halliburton RMT, and a preference for Halliburton RMT over Schlumberger RST-C. As understood by those skilled in the art, a predetermined ranking within a field can be updated as tools are updated, revised, released, or discontinued.

As illustrated in FIGS. 6A, 6B, 6C, 6D, and 6E, an example embodiment of the present invention can include a method of determining a well-logging tool selection for reservoir saturation monitoring responsive to a plurality of characteristics for various well-logging tools from multiple vendors and responsive to user inputs associated with a candidate well. As shown in the flow chart beginning in FIG. 6A, the expert system begins with a candidate well 21. The expert system first checks the minimum tubing restriction (MTR) 22. If the MTR is less than, for example, 1.79", then the MTR is too small 23. The well is not a good candidate, and the expert system recommends consulting with specialized petrophysicists 25. If the minimum tubing restriction (MTR) is not less than 1.79", then the expert system checks the logging interval 24. If the logging interval is not greater than 20', then the logging interval is too short 26. The well is not a good candidate, and the expert system recommends consulting with specialized petrophysicists 25. If the logging interval is greater than 20', then the expert system checks if the well is a key well. As understood by those skilled in the art, a key well is a critical or important well, in which well-logging cost is a secondary consideration. If the well is a key well, the expert system recommends: a production log (PLT) if the well is flowable; carbon-oxygen logging and resistivity logging; a water sample; and data integration 28. As understood by those skilled in the art, a production log creates a record of measurements in the borehole for the purpose of analyzing dynamic well performance and the productivity or infectivity of different zones, diagnosing problem wells, or monitoring the results of a stimulation or completion. If the well is not a key well, the expert system checks if the well is flowable 29. If the well is not flowable, it is dead 31. The well is not a good candidate, and the expert system recommends consulting with specialized petrophysicists 25. If the well is flowable, the expert system checks if the water cut (WC) is greater than zero 35. If the water cut is greater than zero, the expert system continues at A 35, wherein the well is wet producer. See FIG. 6B. If the water cut is not greater than zero, i.e., the well is a dry producer, then the expert system checks if the purpose is to monitor the water-oil contact (WOC) movement 33. If the purpose is not just to monitor the WOC movement, then the well is not a good candidate, and the expert system recommends consulting with specialized petrophysicists 25. If the purpose is to monitor the WOC movement, then the expert system checks if this is a fresh water environment 34 (i.e., TDS<50 ppk). If it is not a freshwater environment, the expert system recommends open-hole resistivity or PNL logging to be run 37. If it is a freshwater environment, the expert system recommends running CO logging 36.

Figure 6A:
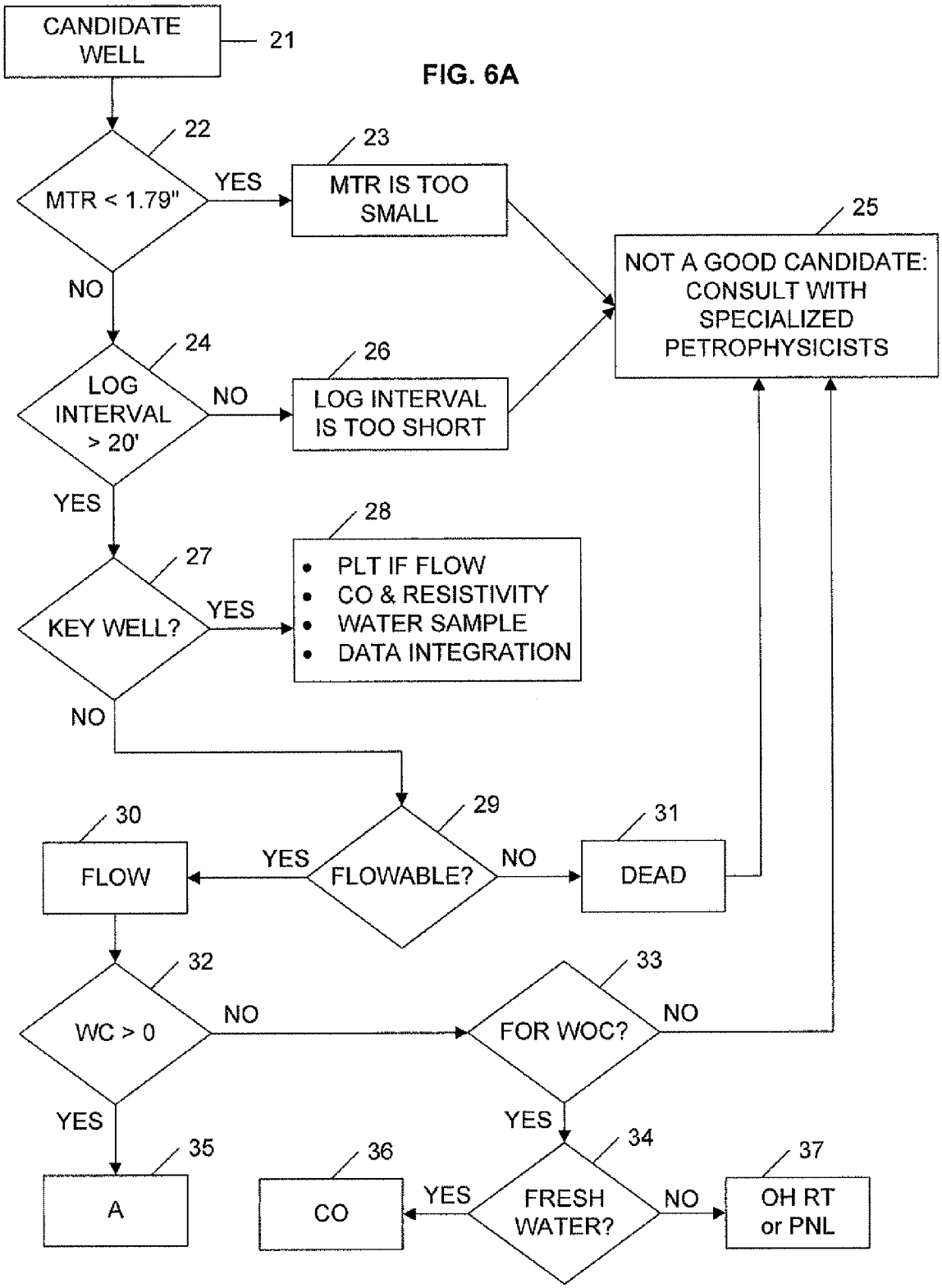
FIGS. 6A, 6B, 6C, 6D, and 6E illustrate a logic diagram for selecting a fit-for-purpose tool for reservoir saturation monitoring for a candidate well according to an embodiment of the present invention.
Figure 6B:
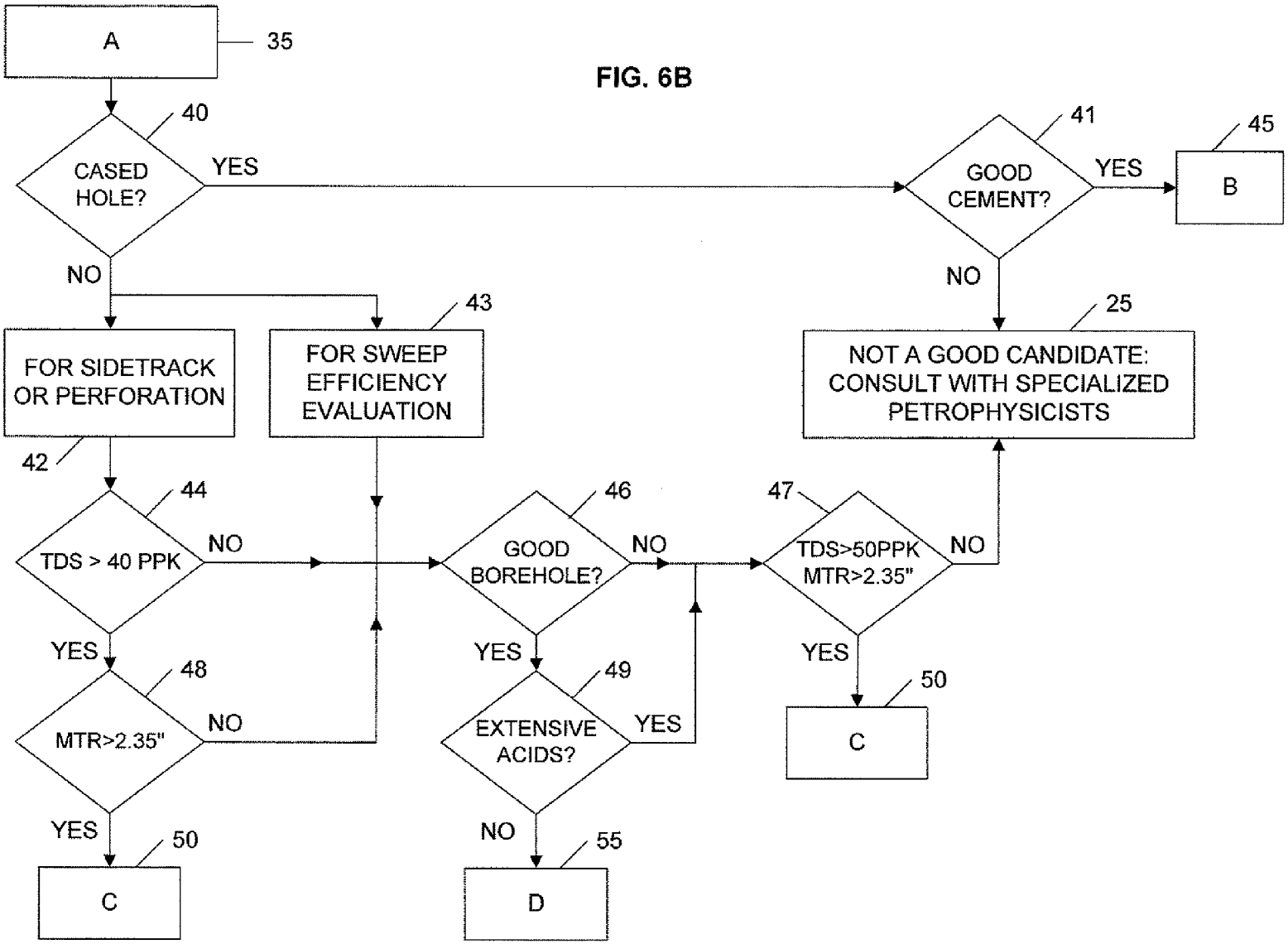

As shown in the flow chart with FIG. 6B, the expert system of an example embodiment continues with A 35, wherein the well is a wet producer. The expert system checks if the borehole is cased (or open) 40. If the borehole is not cased, i.e., it is open, the expert system checks the objective of the reservoir saturation monitoring 42, 43. If the objective of the reservoir saturation monitoring is identifying remaining pay for sidetrack or perforation 42, then the expert system checks if the TDS is greater than 40 ppk, as shown at 44. If the TDS is greater than 40 ppk, then the expert systems checks if the MTR is greater than 2.35", as shown at 48. If the MTR is greater than 2.35", then the expert system continues at C of FIG. 6D, as shown at 50. If the objective of the reservoir saturation monitoring is evaluating the waterflood sweep efficiency, as shown at 43, or the TDS is not greater than 40 ppk, or the MTR is not greater than 2.35", then the expert system checks if the borehole is of good quality, as shown at 46, having little washout. If the borehole is of good quality, then the expert system checks for extensive acids, as shown at 49. If the there have not been extensive acids, then the expert system continues at D of FIG. 6E, as shown at 55. If, however, the borehole is not of good quality or extensive acids have been used, then the expert system checks if the TDS is greater than 50 ppk and the MTR is greater than 2.35", as shown at 47. If so (i.e., TDS>50 ppk, and MTR>2.35"), then the expert system continues at C of FIG. 6D, as shown at 50. If not (i.e., TDS≦50 ppk, or MTR≦2.35"), then the well is not a good candidate, and the expert system recommends consulting with specialized petrophysicists, as shown at 25. If, however, the borehole is a cased hole, the expert system checks if the cement is good, as shown at 41. If the cement is not good, then the well is not a good candidate, and the expert system recommends consulting with specialized petrophysicists, as shown at 25. If the cement is good, then the expert system continues at B of FIG. 6C, as shown at 45.

Figure 6C:
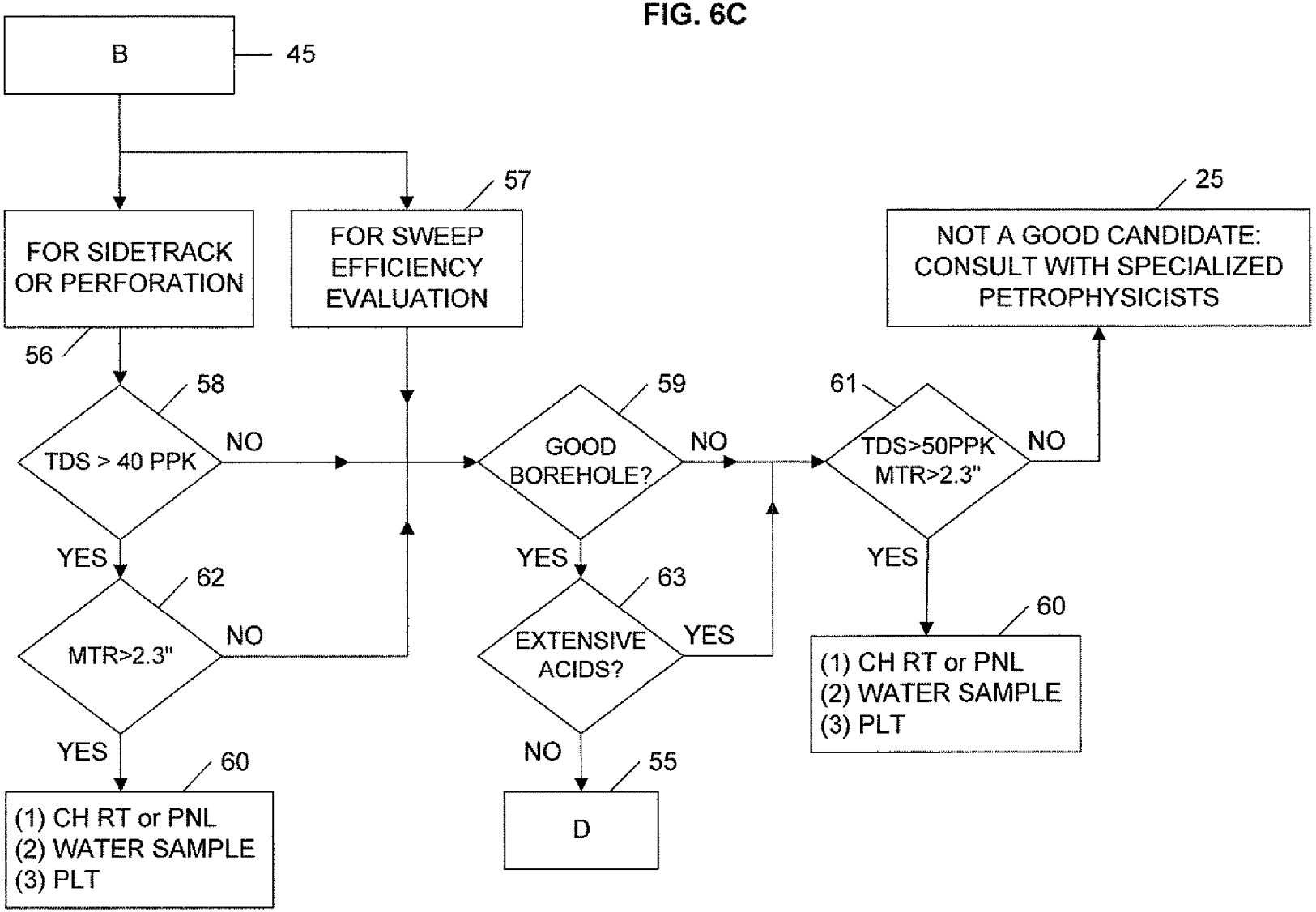

As shown in the flow chart with FIG. 6C, the expert system of an example embodiment continues with B 45, wherein the borehole is cased and has good cement. The expert system checks the objective of the reservoir saturation monitoring 56, 57. If the objective of the reservoir saturation monitoring is identifying remaining pay for sidetrack or perforation 56, then the expert system checks if the TDS is greater than 40 ppk, as shown at 58. If the TDS is greater than 40 ppk, then the expert systems checks if the MTR is greater than 2.3", as shown at 62. If the MTR is greater than 2.3", then the expert system recommends cased-hole resistivity or PNL logging to be run; a water sample; and a production log (PLT) to be performed, as shown at 60. If the objective of the reservoir saturation monitoring is evaluating the waterflood sweep efficiency, as shown at 57, or the TDS is not greater than 40 ppk, or the MTR is not greater than 2.3", then the expert system checks if the borehole is of good quality, as shown at 59. If the borehole is of good quality, then the expert system checks for extensive acids, as shown at 63. If there have not been extensive acids, then the expert system continues at D of FIG. 6E, as shown at 55. If, however, the borehole is not of good quality or extensive acids have been used, then the expert system checks if the TDS is greater than 50 ppk and the MTR is greater than 2.3", as shown at 61. If so (i.e., TDS>50 ppk, and MTR>2.3"), then the expert system recommends cased-hole resistivity or PNL logging to be run; a water sample; and a production log (PLT) to be performed, as shown at 60. If not (i.e., TDS≦50 ppk, or MTR≦2.3"), then the well is not a good candidate, and the expert system recommends consulting with specialized petrophysicists, as shown at 25.

Figure 6E:
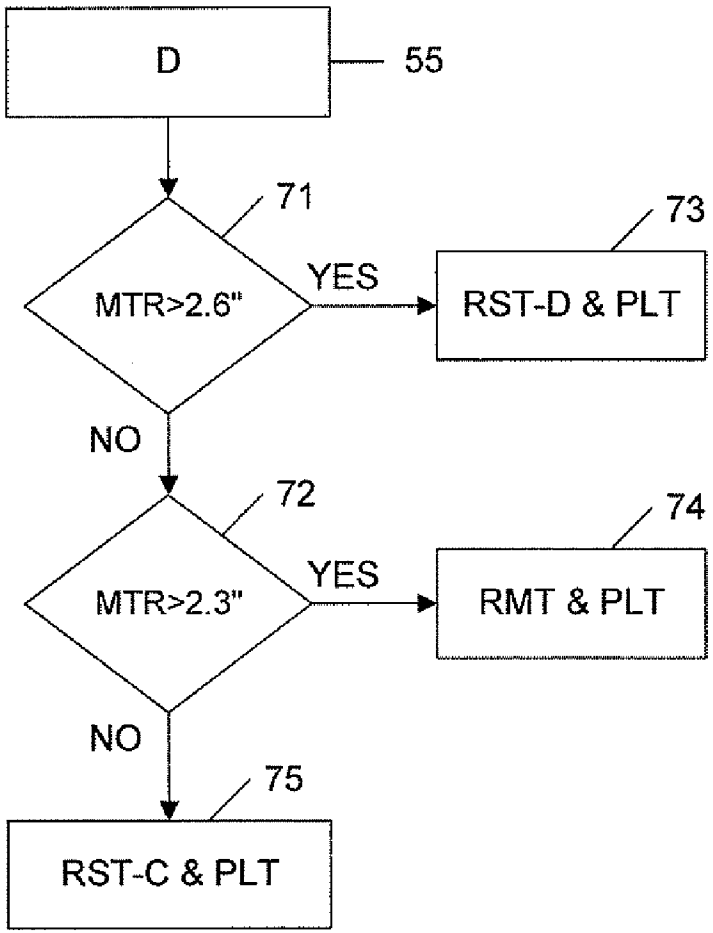
Figure 6D:
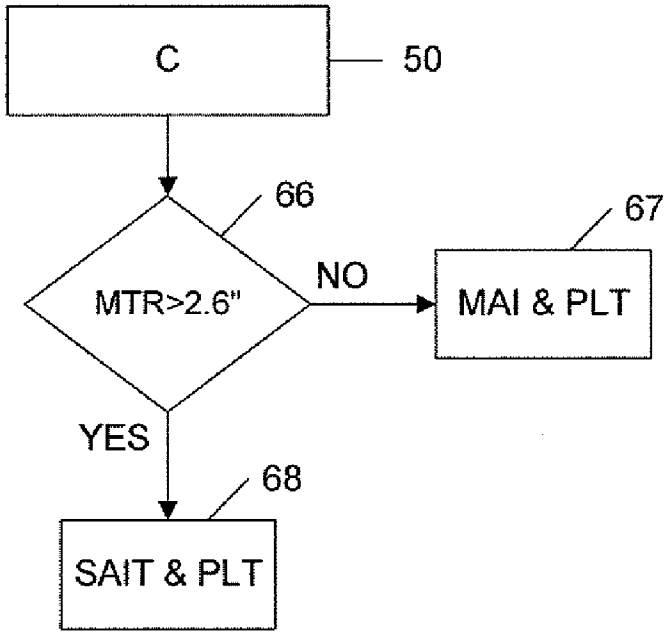

As shown in the flow chart with FIG. 6D, the expert system of an example embodiment continues with C 50. The expert system checks if MTR is greater than 2.6", as shown at 66. If the MTR is greater than 2.6", then the expert system recommends Schlumberger SAIT and PLT, as shown at 68. If the MTR is not greater than 2.6", then the expert system recommends Weatherford MAI and PLT, as shown at 67.

As shown in the flow chart with FIG. 6E, the expert system of an example embodiment continues with D 55. The expert system checks if MTR is greater than 2.6", as shown at 71. If the MTR is greater than 2.6", then the expert system recommends Schlumberger RST-D and PLT, as shown at 73. If the MTR is greater than 23", then the expert system recommends Halliburton RMT and PLT, as shown at 74. If the MTR is not greater than 2.3", then the expert system recommends Schlumberger RST-C and PLT, as shown at 75.

Embodiments of the present invention include, for example, other methods, logic flows, and recommendations beyond the example illustrated in FIGS. 6A, 6B, 6C, 6D, and 6E. A person having ordinary skill in the art will recognize, for example, that new well logging products, vendors, or technologies are included in the embodiments of the present invention.

As understood by those skilled in the art, the machine embodiments 150 can include various computers and computer architectures, including various operating systems and hardware embodiments. Example embodiments can include industrial or commercial computers and can be configured and programmed as a computer, a server, or a system of distributed computers or servers that at least include memory 153, program product 154, one or more processors 152, and an input/output (I/O) interface 151, as shown in FIG. 3. The computer I/O interfaces 151 can connect the computer 150 to the other computers in the computer system through an electronic communications network [not shown], e.g., the Internet. The input/output (I/O) interface 151 can be any I/O device including, but not limited to a network card/controller connected by a PCI bus to the motherboard, or hardware built into the motherboard of the computer 150 to connect same to the network. As can be seen, the input/output (I/O) interface 151 is connected to the processor 152. Processor 152 is the "brains" of the computer 150, and as such executes program product 154 and works in conjunction with the input/output (I/O) interface 151 to direct data to the tangible and non-transitory memory 153 and to send data from memory 153 to the other computers in the computer system as understood by those skilled in the art. Processor 152 can be any commercially available processor, or plurality of processors, adapted for use for the computer 150, e.g., Intel® Xeon® multicore processors, Intel® micro-architecture Nehalem, AMD Opteron™ multicore processors, etc. As one skilled in the art will appreciate, processor 152 may also include components that allow the computer 150 to be connected to a display and keyboard 156 that would allow a user to directly access the processor 152 and memory 153. Example embodiments can further include hand-held devices and other such terminals as understood by those skilled in the art. A browser, e.g., an Internet browser, or other program product as understood by those skilled in the art communicates may augment the user interface. In addition to browser-based implementations, custom applications can be programmed onto the machine 150; these custom application embodiments configure the computers to implement the technologies described herein and may be optimized for use on particular devices. For example, a hand-held application embodiment may be optimized for the screen and messaging services available with the hand-held device embodiments.

A person having ordinary skill in the art will recognize that various types of computing devices and computer architectures, including, for example, laptops, desktops, distributed computing, cloud computing, data centers, mobile and hand-held devices, and other systems, are embodiments of the present invention, and these embodiments are intended to be included within the scope of the appended claims. That is, the expert system and the machine to select a fit-for-purpose tool for reservoir saturation monitoring, for example, can be implemented through a distributed computing environment or a personal digital assistant (PDA). A person having ordinary skill in the art will also recognize that various types of memory are media readable by a computer such as described herein. Examples of tangible and non-transitory computer readable media include but are not limited to: nonvolatile, hard-coded type media such as read only memories (ROMs), CD-ROMs, and DVD-ROMs, or erasable, electrically programmable read only memories (EEPROMs), recordable type media such as floppy disks, hard disk drives, CD-R/RWs, DVD-RAMs, DVD-R/RWs, DVD+R/RWs, flash drives, memory sticks, and other newer types of memories, and tangible and non-transitory transmission type media such as digital and analog communication links. For example, such media can include operating instructions, as well as instructions related to the system and the method steps described above and can operate on a computer. It will be understood by those skilled in the art that such instructions can be programmed in various computer languages, including, for example, Visual Basic, C++, Java, C, and others.

Although the present invention has been described in detail, it should be understood that various changes, substitutions, and alterations can be made hereupon without departing from the principle and scope of the invention. Accordingly, the scope of the present invention should be determined by the following claims and their appropriate legal equivalents. The singular forms "a", "an" and "the" include plural referents, unless the context clearly dictates otherwise. Optional or optionally means that the subsequently described event or circumstances may or may not occur. The description includes instances where the event or circumstance occurs and instances where it does not occur. Ranges may be expressed herein as from about one particular value, and/or to about another particular value. When such a range is expressed, it is to be understood that another embodiment is from the one particular value and/or to the other particular value, along with all combinations within said range.

Throughout this application, where patents or publications are referenced, the disclosures of these references in their entireties are intended to be incorporated by reference into this application, in order to more fully describe the state of the art to which the invention pertains, except when these reference contradict the statements made herein.

That claimed is:

1. A machine to select a fit-for-purpose tool for reservoir saturation monitoring, the machine comprising:

a processor positioned to determine a well-logging tool selection responsive to a plurality of characteristics of a well-logging tool for a plurality of well-logging tools from a plurality of vendors and responsive to conditions for a candidate well, the characteristics of a well-logging tool including an outer diameter of the tool and a well-logging technology utilized by the tool;

an input/output interface for receiving and displaying data between the processor and a user; and a memory having stored therein a computer program product, stored on a tangible and non-transitory computer memory media, operable on the processor, the computer program product comprising a set of instructions that, when executed by the processor, cause the processor to determine a well-logging tool selection by performing the operations of:

storing the plurality of characteristics for the plurality of well-logging tools to thereby enable categorization of the well-logging tools from the plurality of vendors, the categorization being according to the plurality of characteristics, receiving by the processor a first one or more inputs from the user, each of the one or more inputs associated with a condition of a candidate well to thereby avoid irrelevant input gathering, communicating with the user for a second one or more inputs associated with the conditions of the candidate well by the processor through the input/output interface responsive to the first one or more inputs so that additional relevant inputs are received by the processor, comparing by the processor the stored plurality of characteristics for the plurality of well-logging tools to the first and second one or more inputs associated with conditions of the candidate well, and determining a well-logging tool selection by the processor responsive to the comparison of the stored plurality of characteristics for the plurality of well-logging tools to the first and second one or more inputs to select a fit-for-purpose tool for reservoir saturation monitoring so that the processor creates for the user a recommendation for reservoir saturation monitoring of the candidate well.

2. The machine of claim 1, wherein the stored plurality of characteristics of the plurality of well-logging tools includes each of the following technologies: carbon-oxygen, resistivity, and pulse-neutron capture.

3. The machine of claim 1, wherein the first and second one or more inputs include: a minimum tubing restriction of the candidate well; whether a wellbore of the candidate well is open or cased; whether the candidate well is a wet producer; and whether the candidate well is a key well in which well-logging cost is a secondary consideration, so that the determination of the well-logging tool selection by the processor eliminates well-logging tools responsive to mechanical fit, ill-suited technology for the conditions of the candidate well, and cost considerations.

4. The machine of claim 3, wherein the operation of determining a well-logging tool selection by the processor responsive to the comparison of the stored plurality of characteristics for the plurality of well-logging tools to the first and second one or more inputs so that the processor creates for the user a recommendation for reservoir saturation monitoring of the candidate well further includes:

eliminating from the selection any of the plurality of well-logging tools when an outer diameter of the tool is greater than or equal to a minimum tubing restriction of the candidate well so that the processor selects well-logging tools responsive to a mechanical fit with the candidate well; and selecting a single well-logging tool for a particular technology responsive to a predetermined ranking to thereby avoid duplication of well-logging tools with respect to the particular technology.

5. The machine of claim 1, wherein the first and second one or more inputs include an objective of the reservoir saturation monitoring so that the processor selects well-logging tools responsive to the objective of the reservoir saturation monitoring for the candidate well; and wherein the objective includes one or more of the following: evaluating sweep efficiency; and identifying remaining pay for sidetrack or perforation.

6. The machine of claim 1, wherein the operations further include displaying to the user on a display screen of the machine a representation of a mechanical fit of a well-logging tool and a candidate well responsive to the stored plurality of characteristics for the plurality of well-logging tools and the first and second one or more inputs associated with the candidate well.

7. The machine of claim 1, wherein the determined well-logging tool selection includes one or more of the following: a consultation with a specialized petrophysicist; and a combination of more than one tools of the plurality of well-logging tools.

8. A computer program product, stored on a tangible and non-transitory computer memory media, operable on a computer, the computer program product comprising a set of instructions that, when executed by the computer, cause the computer to determine a well-logging tool selection by performing the operations of:

storing in a database in tangible and non-transitory computer memory media a plurality of characteristics of a well-logging tool for a plurality of well-logging tools from a plurality of vendors, the characteristics of a well-logging tool including an outer diameter of the tool and a well-logging technology utilized by the tool, to thereby enable categorization of the well-logging tools from the plurality of vendors, the categorization being according to the plurality of characteristics;

obtaining from a user a plurality of inputs associated with conditions of a candidate well so that the computer can select amongst the plurality of well-logging tools according to the categorization of the well-logging tools responsively to the conditions of the candidate well;

comparing the stored plurality of characteristics for the plurality of well-logging tools to the plurality of inputs associated with conditions of the candidate well; and determining a well-logging tool selection responsive to the comparison of the stored plurality of characteristics for the plurality of well-logging tools to the plurality of inputs associated with conditions of the candidate well to select a fit-for-purpose tool for reservoir saturation monitoring so that the computer creates for the user a recommendation for reservoir saturation monitoring of the candidate well.

9. The computer program product of claim 8, wherein the stored plurality of characteristics of the plurality of well-logging tools includes each of the following technologies: carbon-oxygen, resistivity, and pulse-neutron capture; and wherein the plurality of inputs associated with conditions of the candidate well include each of: a minimum tubing restriction of the candidate well, whether a borehole of the candidate well is open or cased, whether the candidate well is a wet producer, whether the candidate well is a key well in which well-logging cost is a secondary consideration, and an objective of the reservoir saturation monitoring for the candidate well, so that the determination of the well-logging tool selection by the computer eliminates well-logging tools responsive to mechanical fit, ill-suited technology for the conditions of the candidate well, cost considerations, and ill-suited technology for the objective of the reservoir saturation monitoring for the candidate well.

10. The computer program product of claim 9, wherein the operation of determining a well-logging tool selection responsive to the comparison of the stored plurality of characteristics for the plurality of well-logging tools to the first and second one or more inputs so that the computer creates for the user a recommendation for reservoir saturation monitoring of the candidate well further includes:

eliminating from the selection any of the plurality of well-logging tools when an outer diameter of the tool is greater than or equal to a minimum tubing restriction of the candidate well; and selecting a single well-logging tool for a particular technology responsive to a predetermined ranking to thereby avoid duplication of well-logging tools with respect to the particular technology.

11. The computer program product of claim 8, wherein the operation of obtaining from a user the plurality of inputs associated with conditions of the candidate well further includes:

receiving a first portion of the plurality inputs from the user to thereby avoid irrelevant input gathering; and prompting the user for a second portion of the plurality of inputs responsive to the first portion of the plurality inputs so that additional relevant inputs are obtained.

12. The computer program product of claim 8, wherein the determined well-logging tool selection includes one or more of the following: a consultation with a specialized petrophysicist; and a combination of more than one tools of the plurality of well-logging tools.

13. A computer-implemented method to select a fit-for-purpose tool for reservoir saturation monitoring, the computer-implemented method comprising:

storing by a computer in a database in tangible and non-transitory computer memory a plurality of characteristics of a well-logging tool for a plurality of well-logging tools from a plurality of vendors, the characteristics of a well-logging tool including an outer diameter of the tool and a well-logging technology utilized by the tool, to thereby enable categorization of the well-logging tools from the plurality of vendors, the categorization being according to the plurality of characteristics;

obtaining from a user by the computer in a first computer process a plurality of inputs associated with conditions of a candidate well so that the computer can select amongst the plurality of well-logging tools according to the categorization of the well-logging tools responsively to the conditions of the candidate well;

comparing by the computer in a second computer process the stored plurality of characteristics for the plurality of well-logging tools to the plurality of inputs associated with conditions of the candidate well from the first computer process; and determining a well-logging tool selection by the computer responsive to the comparison of the stored plurality of characteristics for the plurality of well-logging tools to the plurality of inputs associated with conditions of the candidate well from the first computer process to select a fit-for-purpose tool for reservoir saturation monitoring so that the computer creates for the user a recommendation for reservoir saturation monitoring of the candidate well.

14. The computer-implemented method of claim 13, wherein the stored plurality of characteristics of the plurality of well-logging tools includes each of the following technologies: carbon-oxygen, resistivity, and pulse-neutron capture.

15. The computer-implemented method of claim 13, wherein the step of obtaining from a user by the computer in a first computer process a plurality of inputs associated with conditions of a candidate well further includes:

receiving a first portion of the plurality inputs from the user to thereby avoid irrelevant input gathering; and prompting the user for a second portion of the plurality of inputs responsive to the first portion of the plurality inputs so that additional relevant inputs are obtained.

16. The computer-implemented method of claim 13, wherein the plurality of inputs associated with conditions of the candidate well include each of: a minimum tubing restriction of the candidate well; whether a borehole of the candidate well is open or cased; whether the candidate well is a wet producer; and whether the candidate well is a key well in which well-logging cost is a secondary consideration, so that the determination of the well-logging tool selection by the computer eliminates well-logging tools responsive to mechanical fit, ill-suited technology for the conditions of the candidate well, and cost considerations.

17. The computer-implemented method of claim 16, wherein the step of determining a well-logging tool selection by the computer responsive to the comparison of the stored plurality of characteristics for the plurality of well-logging tools to the plurality of inputs associated with conditions of the candidate well from the first computer process so that the computer creates for the user a recommendation for reservoir saturation monitoring of the candidate well further includes:

eliminating from the selection any of the plurality of well-logging tools when an outer diameter of the tool is greater than or equal to a minimum tubing restriction of the candidate well so that the computer selects well-logging tools responsive to a mechanical fit with the candidate well; and selecting a single well-logging tool for a particular technology responsive to a predetermined ranking to thereby avoid duplication of well-logging tools with respect to the particular technology.

18. The computer-implemented method of claim 13, wherein the plurality of inputs associated with conditions of a candidate well include an objective of the reservoir saturation monitoring for the candidate well so that the computer selects well-logging tools responsive to the objective of the reservoir saturation monitoring for the candidate well.

19. The computer-implemented method of claim 18, wherein the objective of the reservoir saturation monitoring for the candidate well includes one or more of the following: evaluating sweep efficiency; and identifying remaining pay for sidetrack or perforation.

20. The computer-implemented method of claim 13, wherein the determined well-logging tool selection includes one or more of the following: a consultation with a specialized petrophysicist; and a combination of more than one tools of the plurality of well-logging tools.

* * * * *